US006895099B2

(12) United States Patent
Lee et al.

(10) Patent No.: US 6,895,099 B2
(45) Date of Patent: May 17, 2005

(54) COMPACT SPEAKER FOR PORTABLE PHONE

(75) Inventors: Chun-Hee Lee, Suwon-si (KR); Je-Hyuk Lee, Suwon-si (KR)

(73) Assignee: Samsung Electro-Mechanics Co., Ltd., Kyunggi-do (KR)

( * ) Notice: Subject to any disclaimer, the term of this patent is extended or adjusted under 35 U.S.C. 154(b) by 371 days.

(21) Appl. No.: 09/984,256

(22) Filed: Oct. 29, 2001

(65) Prior Publication Data

US 2003/0044040 A1 Mar. 6, 2003

(30) Foreign Application Priority Data

Aug. 31, 2001 (KR) ..... 2001-53311

(51) Int. Cl.[7] ..... H04R 25/00

(52) U.S. Cl. ..... 381/396; 381/398; 381/189; 381/412; 381/420; 381/151

(58) Field of Search ..... 381/151, 398, 381/152, 391, 396, 189, 412, 171, 431, 172, 400, 420, 371, 372, 433; 340/388.1, 384.1, 311.1, 407.1, 825.46, 7.6

(56) References Cited

U.S. PATENT DOCUMENTS 4,284,857 A * 8/1981 Slavin
6,400,825 B1 * 6/2002 Miyamoto
6,513,623 B2 * 2/2003 Sugiyama
6,618,487 B1 * 9/2003 Azima

* cited by examiner

*Primary Examiner*—Curtis Kuntz
*Assistant Examiner*—Dionne Harvey
(74) *Attorney, Agent, or Firm*—Morgan, Lewis & Bockius LLP

(57) ABSTRACT

A speaker for a portable phone capable of being assembled without bonding by adhesives is disclosed. The speaker has a protector having a plurality of sound holes, and having an annular tension extension formed at a periphery thereof and extended upwardly and outwardly; a frame having a stepped portion and a cylindrical wall extended upwardly from the periphery of the stepped portion and having locking means; a diaphragm seated on the stepped portion of the frame and intended to generate sound; a voice coil attached to a lower surface of the diaphragm and adapted to vibrate; a top plate disposed in the voice coil; and a magnet fixedly disposed between the top plate and the frame and adapted to generate a predetermined magnetic field.

5 Claims, 6 Drawing Sheets

COMPACT SPEAKER FOR PORTABLE PHONE

BACKGROUND OF THE INVENTION

1. Field of the Invention

The present invention relates to a compact speaker for a portable phone, and more particularly, to a compact speaker for a portable phone which enables assembly of a diaphragm and a protector into a frame to be easily achieved without a bonding procedure, so that assembly productivity of a speaker can be improved, and resonant frequency of the speaker can be extremely lowered, thereby contributing to stabilization of sound pressure.

2. Description of the Prior Art

In general, speakers, which are incorporated in a variety of mobile communication equipments such as portable phones (a cellular phone or a PCS (PHS) phone) to generate a ring tone, have been made compact in accordance with the trend toward miniaturization.

Such a speaker is intended to convert electrical energy to kinetic energy by a voice coil positioned in a space on the basis of Fleming's left hand rule, stating that if a conductor through which an electric current flows is positioned perpendicular to the direction of a magnetic field, then that conductor will experience a mechanical force. That is, if a current signal including various frequencies is applied to a voice coil, the voice coil generates kinetic energy depending on levels of a current and a frequency and vibrates a diaphragm attached thereto, thereby generating sound of frequency perceptible to human ears.

Among instruments for generating sound pressure, those which are adapted to generate sound pressure having relatively low intensity and used in close contact with an ear of a human body are referred to as receivers, while those which are adapted to generate sound pressure having relatively high intensity and used at a distance from an ear of a human body are referred to as speakers.

Speakers have a magnetic circuit which is designed to cause magnetic flux from a permanent magnet to be directed perpendicular to a voice coil received in a space by disposing the magnet and a top plate in a yoke of ferromagnetic metal. The voice coil is attached to a diaphragm so that it can generate up-and-down vibration in response to an input signal to vibrate the diaphragm attached to a frame, thereby enabling sound pressure to be generated. Such a diaphragm usually has variously shaped waves thereon so as to achieve excellent response and negation of buckling phenomenon during its up-and-down vibration. In this way, a shape of a diaphragm serves as a design variable having the greatest effect on frequency characteristic.

Although speakers have not undergone major design changes for a long time, they tend to be made continuously more compact, light in weight and high in efficiency in accordance with commercial availability of high energy permanent magnets, development of molding techniques for small components and miniaturization in communications fields.

In particular, miniaturization of mobile communication equipments can be achieved by miniaturization of components having mechanical dynamic characteristics such as receivers, speakers, buzzers and vibrators. For this purpose, research and development is actively carried out to promote the integration of such mechanical components.

Although a major part of common mobile communication equipments such as portable phones have used buzzers up to now in order to generate a ringing tone, speakers having excellent frequency characteristic are gradually substituted for buzzers to meet demand for various kinds of ringing tones suiting users' tastes, preferences or comfort.

A conventional small sized speaker is usually mounted at a certain position of a portable phone as a separate component. Lately, a speaker tends to be integrated to a vibrating motor.

The above type of speaker integrated to a vibrating motor is illustrated in FIGS. 1 and 2. FIGS. 1 and 2 are an exploded perspective view showing the above type of speaker integrated to a vibrating motor and a cross-sectional view showing the assembled speaker, respectively. As shown in the drawings, the speaker 1 comprises a protector 2 formed with a sound holes 2*a* for allowing a plurality of different sounds to be emitted therethrough, a diaphragm 5 for generating sounds by its vibration due to sound pressure, a voice coil 6 attached to a bottom surface of the diaphragm 5 and adapted to vibrate by voice current applied thereto, and a frame 1 adapted to receive the voice coil 6 and the diaphragm 5 and to allow the protector 2 to be seated therein.

The frame 1 has an annular stepped portion 1*a* to allow the peripheral rim of the diaphragm 5 to be seated thereon, and an inner surface 1*b* for receiving the diaphragm 5 and the protector 2.

The protector 2 has a rim 2*b*, which is adapted to be forcedly fitted to the inner surface 1*b* and to be in close contact with the inner surface 1*b*.

In an assembling procedure of the above conventional speaker, a predetermined quantity of adhesive is applied to an adhesive-applying area "A" of the annular stepped portion 1*a* on which the peripheral rim of the diaphragm 5 is to be seated, and then the peripheral rim of the diaphragm 5 which has the voice coil 6 attached thereto is bonded to the annular stepped portion 1*a* with the adhesive therebetween. After completion of the bonding procedure, the protector 2 is forcedly fitted to the inner surface 1*b* of the frame 1, thereby completing the assembling procedure of the speaker.

However, in the conventional process for bonding a diaphragm to a frame of a small sized speaker by applying adhesive therebetween, an operation for precisely bonding a diaphragm to a frame having a diameter of only about 10 mm is very difficult. Furthermore, when carrying out an operation for assembling a protector into the frame, the protector tends to stick to the frame because of the adhesive applied to the frame.

In addition, the conventional small sized speaker which is assembled by using a bonding technique has disadvantages in that a targeted applying position and the quantity of adhesive can have a great effect on sound characteristics of the speaker.

That is, owing to the effect of adhesive, a minimum resonant frequency of sound pressure generated from a speaker becomes a high level of about 800–1100 Hz, and sound pressure at high frequency is not uniform. Hence, the above-mentioned process has a disadvantage in that it is difficult to apply to actual products (see FIG. 9).

Furthermore, the above conventional process of bonding a diaphragm by means of adhesive has another disadvantage in that productivity of small sized speakers is lowered because an application operation of adhesive must be carefully carried out.

SUMMARY OF THE INVENTION

Accordingly, the present invention has been made keeping in mind the above problems occurring in the prior art, and an object of the present invention is to provide a compact speaker for a portable phone which enables assembly of a diaphragm and a protector into a frame to be easily achieved without an use of adhesives, so that a resonant frequency of speaker can be most lowered, thereby contributing to stabilization of sound pressure.

In order to accomplish the above object, the present invention provides a compact speaker for a portable phone comprising: a protector having a plurality of sound holes for allowing sound generated in the speaker to be passed through therethrough, and having an annular tension extension integrally formed at a periphery thereof and extended upwardly and outwardly; a frame having an integral stepped portion and a cylindrical wall extended upwardly from the periphery of the stepped portion, the cylindrical wall being provided at its inner surface with a locking protrusions; a diaphragm seated on the stepped portion of the frame and intended to generate sound by vibration due to sound pressure; a voice coil attached to a lower surface of the diaphragm and adapted to vibrate in response to an electric current applied thereto; a top plate disposed in the voice coil; and a magnet fixedly disposed between the top plate and the frame and adapted to generate a predetermined magnetic field.

According to another aspect, the invention provides a compact speaker for a portable phone comprising: a protector having a plurality of sound holes formed thereon and an annular extension formed at a periphery thereof, the annular extension being extended outwardly and downwardly and being provided at its outer end with a cocking portion to be inwardly folded when being subjected to a cocking operation; a frame having an annular stepped portion of a predetermined width, which is to be gripped by the folded cocking portion; a diaphragm seated on the annular stepped portion and intended to generate sound by it vibration; a voice coil attached to a lower surface of the diaphragm and adapted to vibrate in response to an electric current applied thereto; a top plate disposed in the voice coil; and a magnet fixedly disposed between the top plate and the frame and adapted to generate a predetermined magnetic field.

According to a further aspect, the invention provides a compact speaker for a portable phone comprising: a protector having a plurality of sound holes formed thereon, an extension formed at a periphery thereof and extended downwardly and then inwardly and a cylindrical compressing wall provided inside of the downward and inward extension; a frame having a annular stepped portion, which is bent outwardly and then upwardly and gripped by the downward and inward extension; a diaphragm seated at its periphery on the annular stepped portion and intended to generate sound by vibration due to sound pressure; a voice coil attached to a lower surface of the diaphragm and adapted to vibrate in response to an electric current applied thereto; a top plate disposed in the voice coil; and a magnet fixedly disposed between the top plate and the frame and adapted to generate a predetermined magnetic field.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
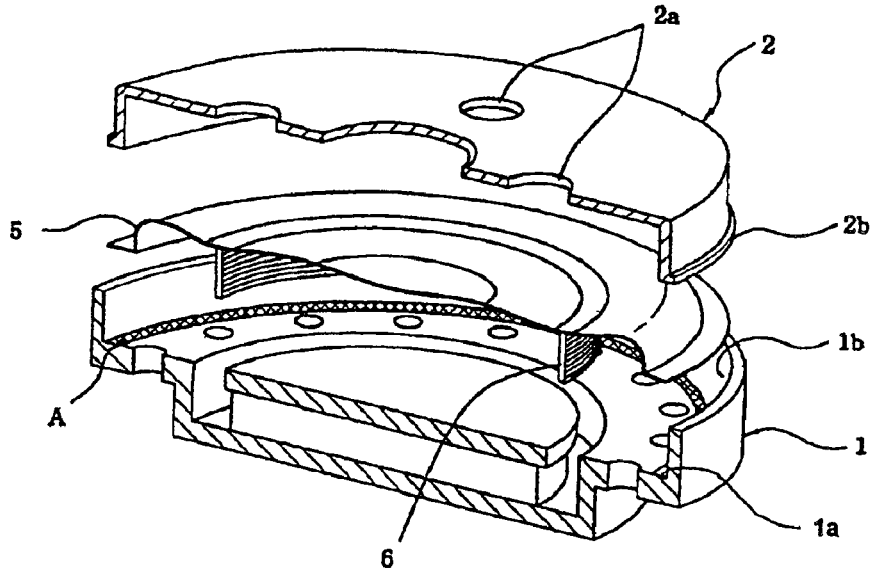
FIG. 1 PRIOR ART
FIG. 1 is an exploded perspective view showing the prior art small sized speaker in which its half portion is cut away.
Figure 2:
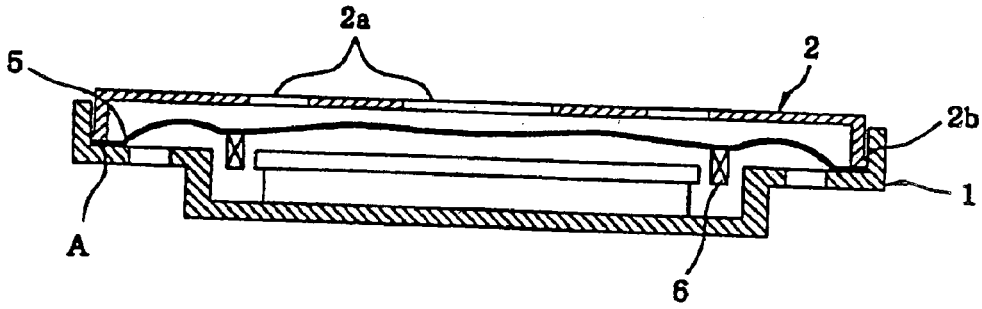
FIG. 2 PRIOR ART
FIG. 2 is a cross-sectional view showing the assembled speaker of FIG. 1.

Reference now should be made to the drawings, in which the same reference numerals are used throughout the different drawings to designate the same or similar components.

Figure 3:
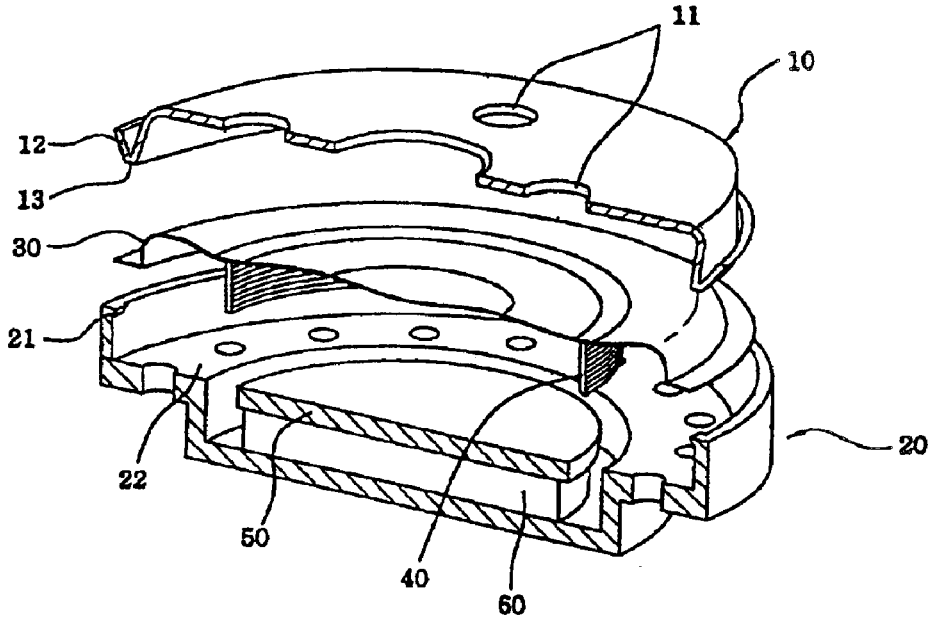
FIG. 3 is an exploded perspective view showing a compact speaker according to the present invention in which its half section is cut away.
Figure 4:
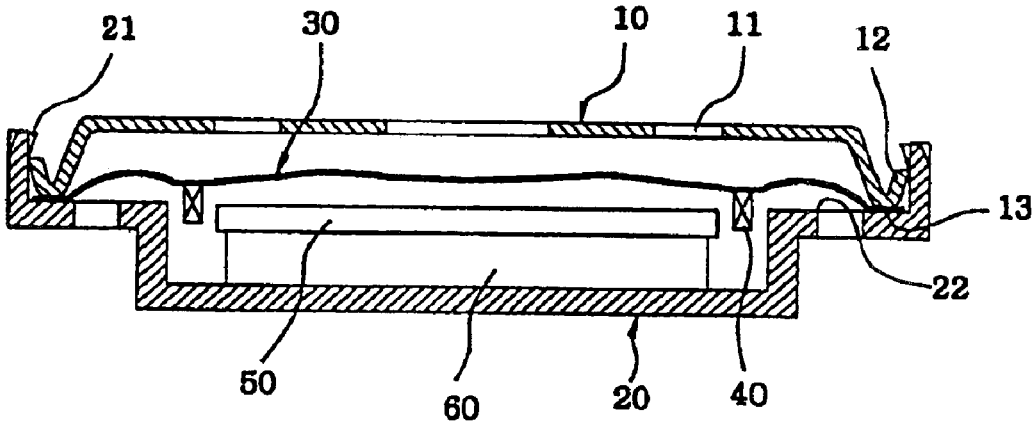
FIG. 4 is a vertical sectional view showing the speaker of FIG. 3 in which its components are assembled.

FIG. 3 is an exploded perspective view showing a compact speaker according to the present invention, a half section of which is cut off for clarity, and FIG. 4 is a vertical sectional view showing the speaker in which its components are assembled.

A compact speaker for a portable phone according to the present invention is adapted to generate a predetermined sound pressure to indicate reception of a sound or data signal transmitted from a base station or a relay station. The assembling operation of the compact speaker is carried out as follows. A yoke (not shown) disposed in a frame 20 is provided with a magnet 60 for forming a predetermined magnetic field and a top plate 50. Then, a diaphragm 30 is positioned over the top plate 50, which is intended to generate sound by a voice coil vibrating due to application of an electric current. More specifically, the diaphragm 30 is seated on an annular stepped portion 22 formed at an inner surface of the frame 20.

After the diaphragm 30 is seated on the annular stepped portion 22, a peripheral portion, that is, a tension rim 12 of a protector 10, which is upwardly curved, is fitted to an inner surface of the frame 20. The tension rim 12 is engaged at its outer end with a plurality of locking protrusions 21 formed at an upper end of the inner surface of the frame 20.

The tension rim 12 is preferably provided at its annular curved ridge with a compressing face 13. The compressing face 13 is adapted to compress the periphery rim of the diaphragm 30 seated on the annular stepped portion 22 such that support for the diaphragm 30 is achieved without application of adhesives.

Figure 10:
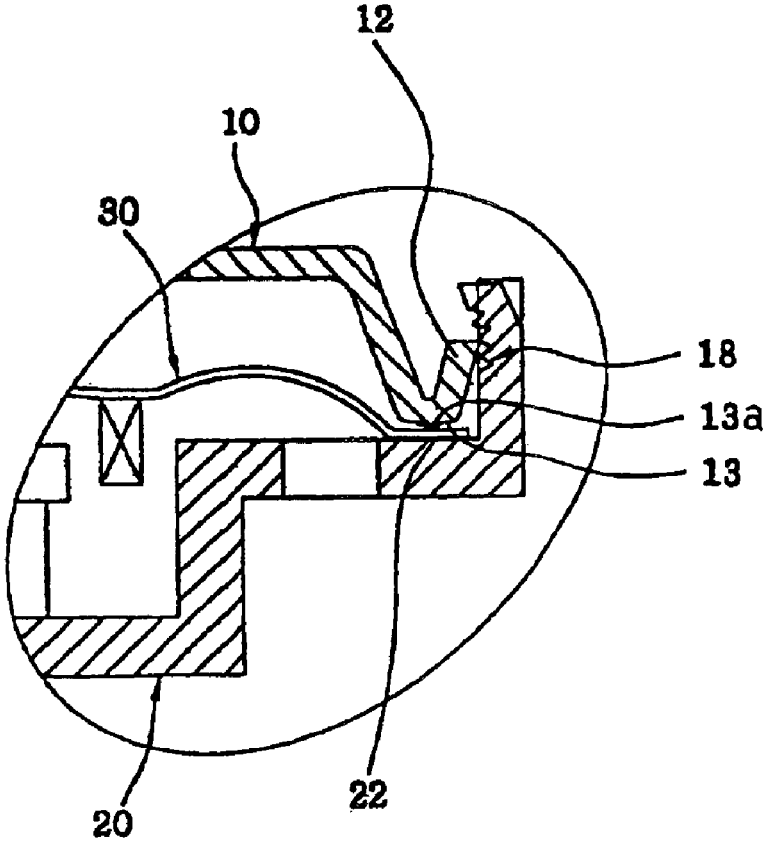
FIG. 10 is an enlarged cross-sectional view showing a raised protrusion on the annular curved ridge.

Furthermore, the compressing face 13 may be formed with engaging protrusions each having a predetermined size so that the compressing face 13 can firmly support the diaphragm 30 without slippage therebetween. See FIG. 10. However, the engaging protrusions formed at the compressing face 13 can be of any other shape and size, as long as the compressing face 13 can have ability sufficient to firmly support the diaphragm 30 without allowing play of the diaphragm 30.

Figure 5:
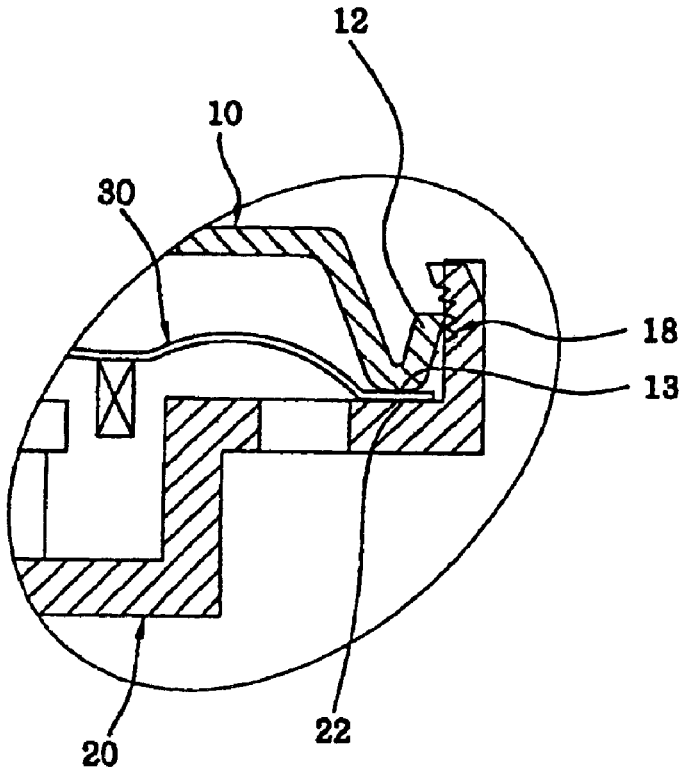
FIG. 5 is an enlarged cross-sectional view showing a coupling structure.

Referring to FIG. 5, there is shown another embodiment of the present invention. As shown in the drawing, for locking the tension rim 12 to the frame 20, the frame 20 may be formed at its inner surface with serration grooves 18 so that the free end of the tension rim 12 of the protector 10 can be engaged with the serration grooves 18.

Figure 6:
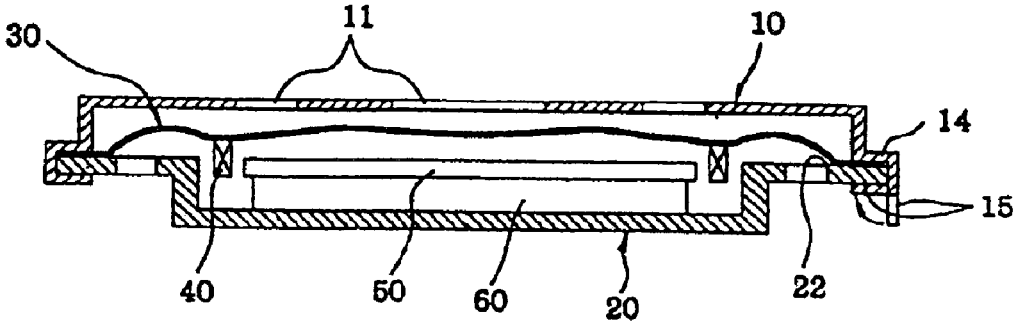
FIG. 6 is a cross-sectional view showing a coupling structure of a protector and a frame of another embodiment of the invention.

Referring to FIG. 6, there is shown a further embodiment of the present invention. As shown in the drawing, a speaker according to the present embodiment comprises a protector 10 having a plurality of sound holes 11 formed thereon and an annular extension 14 formed at a periphery thereof, the annular extension 14 being extended outwardly and downwardly and being provided at its outer end with a cocking portion 15 to be inwardly folded when being subjected to a cocking operation, a frame 20 having an annular stepped portion 22 of a predetermined width, which is to be gripped by the folded cocking portion 15, a diaphragm 30 seated on the annular stepped portion 22 and intended to generate sound by its vibration, due to sound pressure, a voice coil 40 attached to a lower surface of the diaphragm 30 and adapted to vibrate in response to an electric current applied thereto, a top plate 50 disposed in the voice coil 40, and a magnet 60 fixedly disposed between the top plate 50 and the frame 20 and adapted to generate a predetermined magnetic field.

The cocking portion 15 is initially extended downwardly from the annular extension 14 of the protector 10, as being indicated by a dotted line in FIG. 6. After the protector 10 is seated on the frame 20 with the periphery of the diaphragm 30 interposed between the annular extension 14 and the annular stepped portion 22, the cocking portion 15 is bent in the direction of an arrow, thereby enabling the protector 10 to be coupled to the frame 20 together with the diaphragm 30. As will be understood from the above explanation, the diaphragm 30 and the protector 10 can be firmly assembled to the frame without application of adhesives, differently from the prior art speaker.

Figure 7:
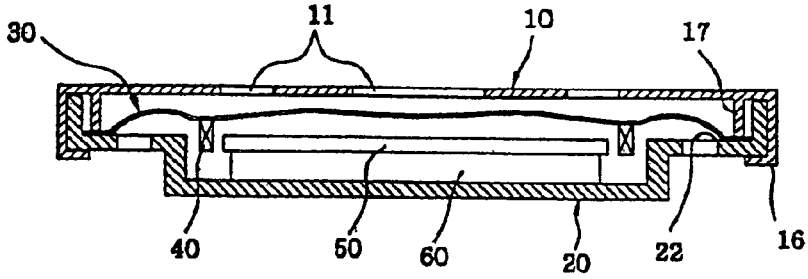
FIG. 7 is a cross-sectional view showing a coupling structure of a protector and a frame of a further embodiment of the invention.

FIG. 7 shows a further embodiment of the present invention. As shown in the drawing, a compact speaker according to the present embodiment comprises a protector 10 having a plurality of sound holes 11 formed thereon, a downwardly and inwardly protruding extension 16 formed at a periphery thereof and a cylindrical compressing wall 17 provided inside of the downward and inward extension 16, a frame 20 having a annular stepped portion 22, which is bent outwardly and upwardly and gripped by the downward and inward extension 16, a diaphragm 30 seated at its periphery on the annular stepped portion 22 and intended to generate sound by vibration, a voice coil 40 attached to a lower surface of the diaphragm 30 and adapted to vibrate in response to an electric current applied thereto, a top plate 50 disposed in the voice coil 40, and a magnet 60 fixedly disposed between the top plate 50 and the frame 20 and adapted to generate a predetermined magnetic field.

A gap defined between a lower end of the cylindrical compressing wall 17 and an inner end of the downward and inward extension 16 is determined such that the gap is smaller than the sum of a thickness of a peripheral portion of the diaphragm 30 and a thickness of the annular stepped portion 22 so that the annular stepped portion 22 and the diaphragm 30 are forcedly and firmly fitted into the downward and inward extension 16. Hence, the cylindrical compressing wall 17 can engage with the upper surface of the diaphragm 30, thereby causing the diaphragm to be locked in place.

As with the above embodiments, the cylindrical compressing wall 17 is capable of compressing and supporting the diaphragm 30 without bonding by adhesives.

In this way, since the compact speaker according to the present invention can be simply and firmly assembled without usage of adhesives, the speaker of the invention has advantages in that it is possible to considerably improve assembling productivity, maintain characteristics of a compact speaker, and achieve minimization of defective fraction of products.

Figure 8:
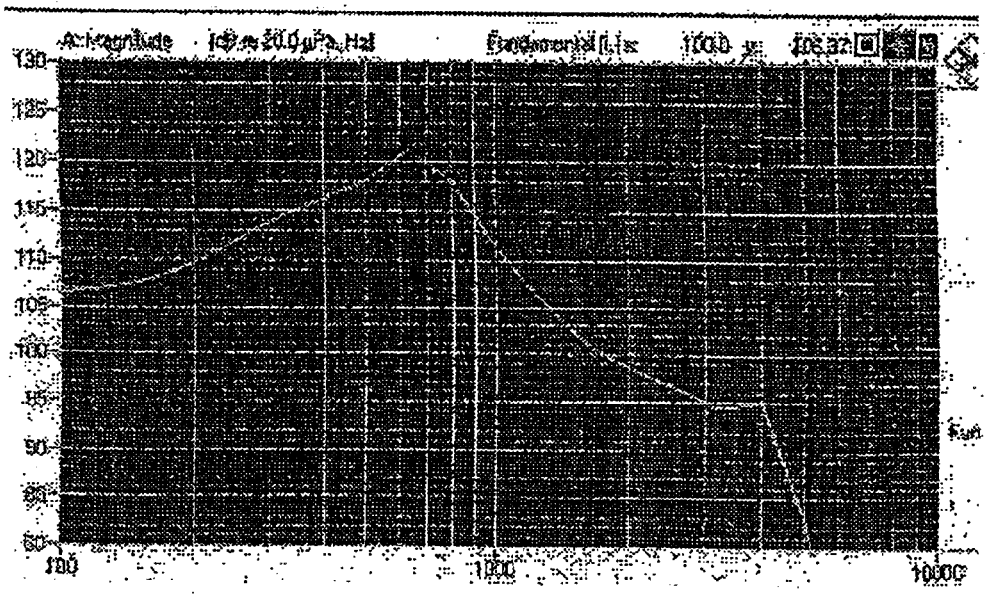
FIG. 8 is a graph showing a resonant frequency of a speaker according to the invention.
Figure 9:
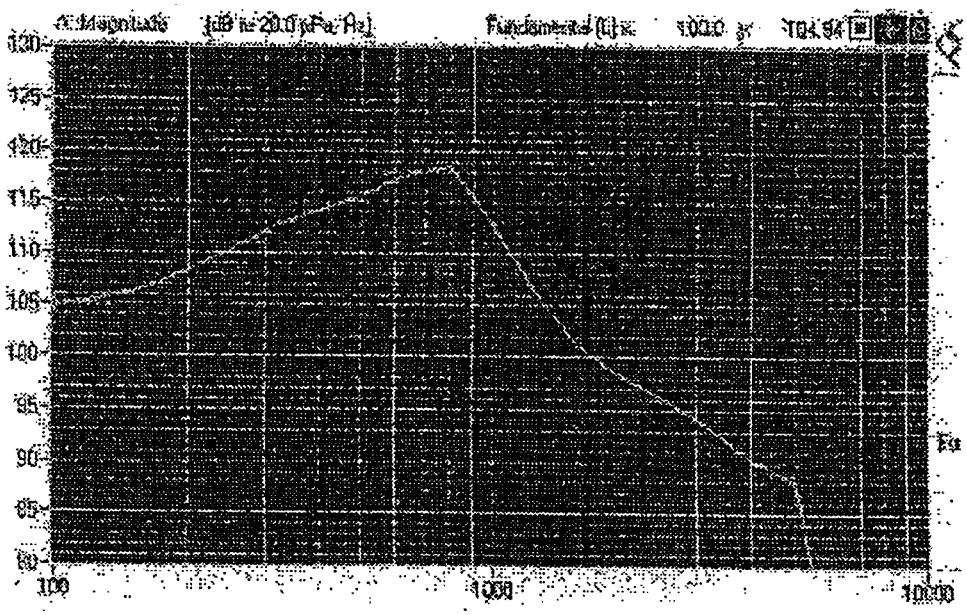
FIG. 9 is a graph showing a resonant frequency of a conventional speaker.

That is, the secure locking of the diaphragm 30 enables uniformity of sound pressure at high frequency which is an inherent attribute of a small sized speaker. As can be understood from the experimental graph shown in FIG. 8, the minimum resonant frequency can be lowered to 600–800 Hz, thereby providing stable voice and acoustic sound.

As described above, the present invention provides a compact speaker for a portable phone capable of being assembled without usage of adhesives, differently from the prior art speaker which is assembled in such a way that adhesive is applied to a frame. That is, the speaker of the invention allows a protector and a frame themselves to be coupled to each other by means of holding means. Therefore, high resonant frequency occurring due to assembly flows of the prior art speaker can be eliminated or considerably reduced. Furthermore, since sound pressure at high frequency becomes uniform, defective fraction of speaker products can be minimized. In addition, assembly procedure of speakers can be simplified, thereby causing productivity to be improved.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A compact speaker for a portable phone comprising:

a protector having a plurality of sound holes for allowing sound generated in the speaker to be passed through therethrough, and having an annular tension extension integrally formed at a periphery thereof and extended upwardly and outwardly;

a frame having an integral stepped portion and a cylindrical wall extended upwardly from the periphery of the stepped portion, the cylindrical wall being provided at its inner surface with a locking protrusions;

a diaphragm seated on the stepped portion of the frame and intended to generate sound by vibration due to sound pressure;

a voice coil attached to a lower surface of the diaphragm and adapted to vibrate in response to an electric current applied thereto;

a top plate disposed in the voice coil; and a magnet fixedly disposed between the top plate and the frame and adapted to generate a predetermined magnetic field.

2. The compact speaker as set forth in claim 1, in which the cylindrical wall is provided at its inner surface with serration grooves for engaging with an outer end of the tension extension.

3. The compact speaker as set forth in claim 1, in which the tension extension is provided with a compressing face having a predetermined width for compressing and supporting the diaphragm.

4. The compact speaker as set forth in claim 3, in which the compressing face is provided with a protrusion having a predetermined shape.

5. A compact speaker for a portable phone comprising:

a protector having a plurality of sound holes formed thereon and an annular extension formed at a periphery thereof, the annular extension being extended outwardly and downwardly and being provided at its outer end with an annular cocking portion to be inwardly folded when being subjected to a cocking operation;

a frame having an annular stepped portion of a predetermined width, which is to be gripped by the folded cocking portion;

a diaphragm seated on the annular stepped portion and intended to generate sound by its vibration;

a voice coil attached to a lower surface of the diaphragm and adapted to vibrate in response to an electric current applied thereto;

a top plate disposed in the voice coil; and a magnet fixedly disposed between the top plate and the frame and adapted to generate a predetermined magnetic field.

* * * * *